United States Patent [19]

Mock et al.

[11] Patent Number: 4,700,874

[45] Date of Patent: Oct. 20, 1987

[54] FANCY ARTEFACT BAND WITH ANNULAR DECORATIVE PORTION SURROUNDING ELONGATED CORE

[75] Inventors: Elmar Mock, Pery; Jean-Marie Hotz, Frinvillier, both of Switzerland

[73] Assignee: ETA S.A. Fabriques d'Ebauches, Grenchen, Switzerland

[21] Appl. No.: 844,424

[22] Filed: Mar. 26, 1986

[30] Foreign Application Priority Data

Apr. 2, 1985 [FR] France ..... 85 05106

[51] Int. Cl.[4] ..... A44C 5/00

[52] U.S. Cl. ..... 224/178; 63/3; D10/32; 224/164

[58] Field of Search ..... 224/164–179; D11/3; D10/32; D2/380–387; 2/338; 63/3; 24/265 WS

[56] References Cited

U.S. PATENT DOCUMENTS

| | | | |
|---|---|---|---|
| D. 171,005 | 12/1953 | Nolin | D11/3 |
| D. 254,963 | 5/1980 | Hofman | D11/3 |
| 2,266,953 | 12/1941 | Blue | 224/178 |
| 2,413,541 | 12/1946 | Brady | D11/3 X |
| 2,437,932 | 3/1948 | Blumstein | D11/3 X |
| 2,542,284 | 2/1951 | Matson | 224/175 X |
| 3,153,245 | 10/1964 | Silverman | 2/338 |
| 3,378,181 | 4/1968 | Hirsch | 224/178 |
| 3,469,749 | 9/1969 | Tabata | 224/178 |
| 3,543,975 | 12/1970 | Bauer | 224/178 |
| 3,545,198 | 12/1970 | Loftus . | |
| 3,962,013 | 6/1976 | Mashida . | |
| 4,178,751 | 12/1979 | Liautaud . | |
| 4,183,986 | 1/1980 | Blaetterlein . | |
| 4,417,753 | 11/1983 | Bacehowski et al. . | |
| 4,462,697 | 7/1984 | Thompson . | |

FOREIGN PATENT DOCUMENTS

| | | | |
|---|---|---|---|
| 2165852 | 8/1973 | France . | |
| 361157 | 5/1962 | Switzerland | 224/173 |
| 518697 | 3/1972 | Switzerland . | |
| 560521 | 4/1975 | Switzerland | 224/178 |
| 628787 | 3/1982 | Switzerland . | |
| 1555848 | 2/1978 | United Kingdom . | |
| 2113975 | 8/1983 | United Kingdom . | |
| 2161695 | 1/1986 | United Kingdom | 224/178 |

*Primary Examiner*—Henry J. Recla
*Assistant Examiner*—Robert M. Petrik
*Attorney, Agent, or Firm*—Pollock, Vande Sande & Priddy

[57] ABSTRACT

The fancy artefact described has a band (3,4) comprising a core portion (5) made of a first thermoplastic plastic material and decorative portions (6) surrounding the core portion (5) over part of its length. The decorative portions (6) are solid with the core portion (5) and are made of a second thermoplastic plastic material which may have a melting temperature equal to or greater than the melting temperature of the first plastic material. One such artefact may be a wristlet having a pair of bands (3,4) secured to the opposite ends of a watch case (1).

12 Claims, 14 Drawing Figures

FANCY ARTEFACT BAND WITH ANNULAR DECORATIVE PORTION SURROUNDING ELONGATED CORE

BACKGROUND OF THE INVENTION

This invention relates to a fancy artefact of the kind including at least one band of generally elongated shape.

Such an article may for instance be a watch wristlet, a belt, a shoulder-bag strap, etc..

SUMMARY OF THE INVENTION

An object of the invention is to provide a fancy artefact of the above set forth kind, which is of pleasing appearance, that can readily be adapted to current fashion trends and which is of low cost price.

To this end said band of the above set forth artefact comprises a core portion of a first thermoplastic plastic material and a decorative portion surrounding said core portion over part of its length, which is solid therewith and which is made of a second thermoplastic plastic material.

BRIEF DESCRIPTION OF THE DRAWINGS

In the accompanying diagrammatic drawings, given by way of example.

DETAILED DESCRIPTION

Figure 1:
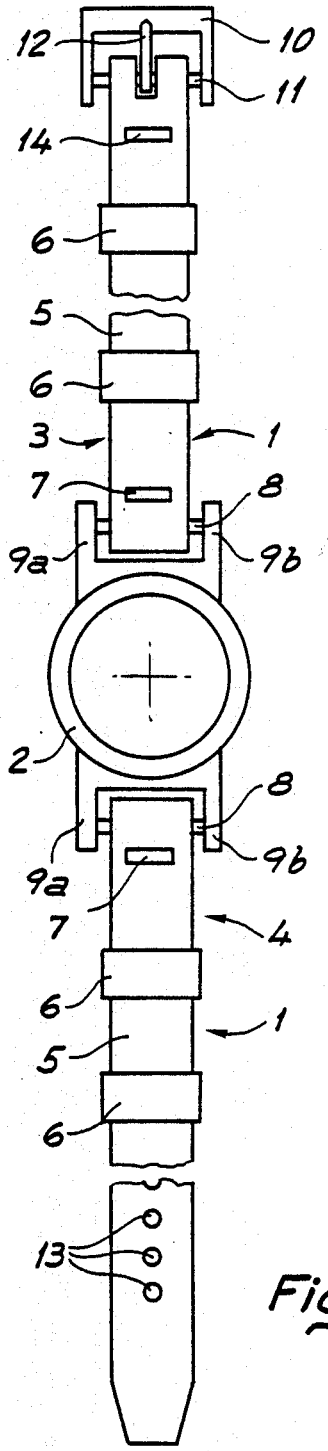
FIG. 1 is a plan view of a watch provided with a wristlet according to the invention.

The wristlet 1 of watch 2 illustrated in FIG. 1 is made up of two bands 3 and 4 of similar construction. Watch 2 may be of any kind and will therefore not be described here.

The various constructional forms for wristlet 1 shown in FIGS. 2 to 11 will be described with reference to band 3.

Figure 2:
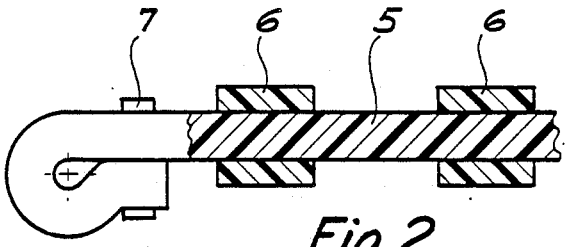
FIGS. 2 to 4 are side views illustrating various forms of construction for the wristlet of FIG. 1, all shown, at least partly, in longitudinal section.

In the constructional form shown in FIG. 2, band 3 comprises a strap-like core portion 5 of substantially rectangular cross-section.

Band 3 further comprises decorative annular-like portions 6 closely surrounding core portion 5 over part of its length. Decorative portions 6 are spaced from each other with core portion 5 being visible in the intermediate gaps. They are also solid with core portion 5 such as to be unable to move in relation to the latter.

Core portion 5 is made, in a manner that will be described later, of a first thermoplastic plastic material which preferably has the property of being flexible at the usual temperatures of use. Such a material may be, for instance a thermoplastic elastomer. Good results have been obtained with a material sold by Atochem of Serquigny in France under the trademark Pebax.

Decorative portions 6 are made, in a manner that will also be described later, of a second thermoplastic plastic material which may be the same as or different from that used for core portion 5 and which has a melting temperature equal to or greater than the melting temperature of the first plastic material. The second plastic material may, for instance, be a polyamide resin of the kind sold by Atochem, referred to above, under the trademark Rilsan.

As shown in FIGS. 1 and 2, band 3 of wristlet 1 is connected to the case of watch 2 in a most conventional way. It includes a loop formed by one end being folded over itself and kept in place by a staple 7. The loop passes round a lug 8 whose ends engage into holes, not shown, drilled into horns 9*a* and 9*b* extending from the watch case.

Wristlet band 4 and the means for securing band 4 to the watch case are much the same as with band 3. Their structural details will therefore not be described again here and bear the same reference numerals as before.

The closure means of wristlet 1 as shown in FIG. 1 are also highly conventional. They consist, on the one hand, of a buckle 10 secured to band 3 by a bar 11 carrying a tongue 12 and, on the other hand, of holes 13 made in band 4 and engageable by tongue 12. Bar 11 extends through a loop formed by the other end of band 3 being folded over itself and held in place by a staple 14.

Bands 3 and 4 may be manufactured separately or together, in a most simple way.

Their manufacture involves a first stage that consists in injecting the plastic material selected for core portion 5 into an appropriately shaped mould at a temperature equal to or greater than its melting temperature.

During a second stage, the plastic material selected for the decorative portions 6 is moulded over the core portion 5 produced during the first stage. This over moulding operation is achieved by injecting the plastic material into a second, appropriately shaped, mould through which core portion 5 is first inserted, at a temperature equal to or greater than its melting temperature.

The injection of the second plastic material around core portion 5 causes the temperature of the latter, where it comes into contact with decorative portions 6, to rise, at least superficially, to a value equal to or greater than its melting temperature. In the contacting areas, the first plastic material melts and forms with second plastic material a layer consisting of an intimate mixture, or even a kind of alloy, of the two plastic materials. Once cooled the layer provides a mechanical bond between core portion 5 and decorative portions 6 which therefore become solid with one another.

The bond between decorative portions 6 and core portion 5 is further improved when core portion 5 is placed, immediately after being injection moulded, before it has fully cooled, in the mould used for producing decorative portions 6.

Figure 3:
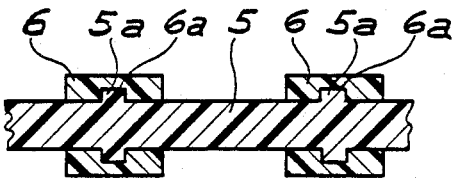

In the constructional form shown in FIG. 3, core portion 5 is formed with protuberances 5*a* where it is surrounded by decorative portions 6, the protuberances engaging in recesses 6*a* in portions 6.

Protuberances 5*a* may have any shape, e.g. that of transverse ribs as shown, and may be provided on one or both sides of core portion 5.

Recesses 6*a* in decorative portions 6 are of course shaped and arranged in a manner complementary to protuberances 5*a*.

Figure 4:
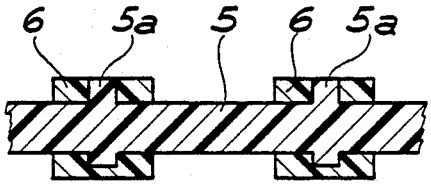

Protuberances 5*a* may have a lesser thickness than decorative portions 6, as shown in FIG. 3, or have, on one side at least of core portion 5, the same thickness as decorative portions 6, as shown in FIG. 4 (or be thicker) so as to be visible.

Figure 5:
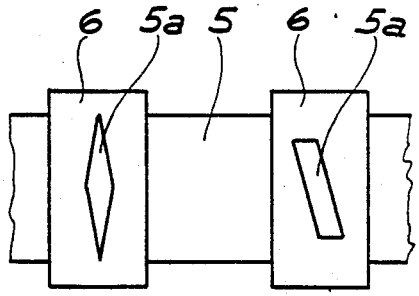
FIG. 5 is a plan view of the FIG. 4 construction.

The visible parts of the protuberances in the latter two cases may have any shape. FIG. 5 illustrates two possible such shapes.

Figure 6:
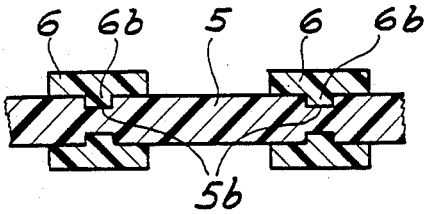
FIGS. 6 and 7 are side views, in longitudinal section, of two more forms of construction for the wristlet of FIG. 1.

In the constructional form shown in FIG. 6, decorative portions 6 have protuberances 6*b* which engage in recesses 5*b* in core portion 5.

Figure 7:
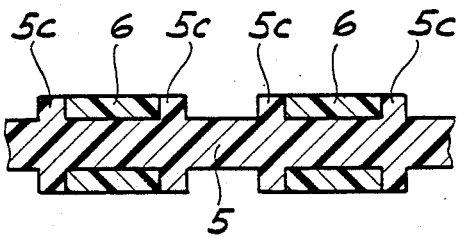
Figure 8:
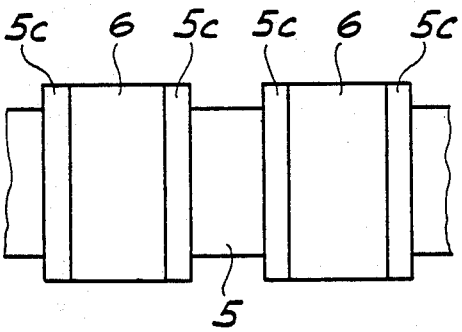
FIG. 8 is a plan view of the FIG. 7 construction.

In the constructional form shown in FIGS. 7 and 8, core portion 5 has protuberances 5c on opposite sides of decorative portions 6. As in the other constructional forms described above, protuberances 5*c* may have any shape and may fully surround or partly surround core portion 5.

Figure 9:
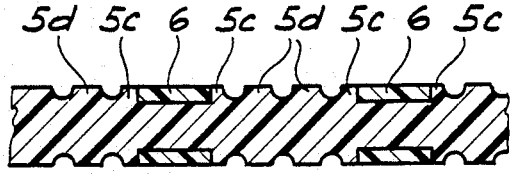
FIGS. 9 and 10 are, respectively a side view in longitudinal section and a plan view of two further forms of construction for the wristlet of FIG. 1.
Figure 10:
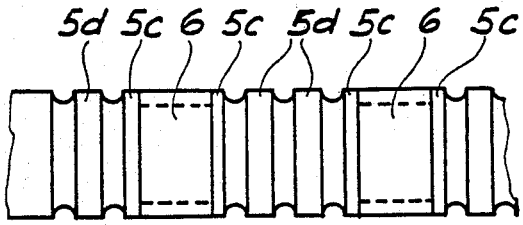

In the constructional form shown in FIGS. 9 and 10, core portion 5 is provided with protuberances 5*c* similar to those in FIGS. 7 and 8 and with protuberances 4*d*, also rib-like, between protuberances 5*c*.

The presence of protuberances 5*a*, 5*b* and 5*c* and of corresponding recesses 6*a* and 6*b* improves and reinforces the bond between core portion 5 and decorative portions 6. This presence also widens the range of materials that can be used to produce wristlet 1 since these materials are no longer required to adhere to one another as in the case of FIG. 2.

Besides improving the bond between core portion 5 and decorative portions 6, the protuberances, such as protuberances 5*a*, when visible as in the case of FIGS. 4 and 5, or 5*c* in FIGS. 7 to 10, may have a substantial aesthetic effect that can readily be modified by altering their shapes. The same applies to protuberances 5*d* which, of course, have no bonding action between core portion 5 and decorative portions 6.

Protuberances 5*d* may be provided in any of the above described constructional forms.

Core portion 5, protuberances 5*a*, 5*c* and 5*d* and decorative portions 6 described above have plane and smooth surfaces that intersect each other at right angles. These surfaces may of course be non planar, i.e. concave or convex, and may or may not intersect each other at right angles. These surfaces may additionally be rough, grooved, etc., nor must decorative portions 6 all have the same shape. In the case of FIGS. 7 to 10, protuberances 5*c* and the sides of decorative portions 6 need not be in contact over their full length.

These constructional forms are not illustrated since their number is practically limitless.

All of the constructional forms for bracelet 1 shown in FIGS. 3 to 10 and of their possible modified forms may be manufactured in a manner similar to that used for FIG. 2. The various protuberances and/or recesses on or in core portion 5 in these various forms are achieved by suitably shaping the mould into which the first plastic material is injected. The recesses and/or protuberances in or on decorative portions 6 are automatically produced when injecting the second plastic material.

Figure 11:
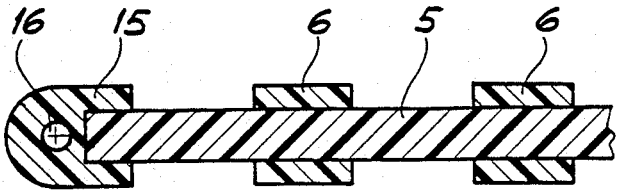
FIG. 11 is a side view, in longitudinal section, of a still further form of construction for the wristlet of FIG. 1.

The constructional form shown in FIG. 11 may be combined with any of the constructional forms shown in FIGS. 3 to 10. In FIG. 11, the loop formed by the end of core portion 5 in FIG. 2 to surround lug 8 is replaced by a securing portion 15 which is made from the same material as that used for decorative portions 6 and during the same injection operation. The end of core portion 5 is surrounded by a part of securing portion 15 and is solid with this part. Securing portion 15 is formed with a hole 16 through which extends lug 8.

In FIG. 11, the part of core portion 5 that is surrounded by securing portion 15 may also have one or more protuberances similar to protuberances 5*a* in FIG. 3 or one or more recesses similar to recesses 5*b* in FIG. 6. Securing portion 15 is then formed with a corresponding recess or recesses or a corresponding protuberance or protuberances.

In this particular form of construction for wristlet 1, band 4 preferably comprises a portion for securing it to the case of watch 2 similar to securing portion 15. Also, closure buckle 10 of wristlet 1 is preferably secured to band 3 by another securing portion similar to portion 15, but provided with a slot in which tongue 12 may move.

What has been said about the shape of decorative portions 6 and the state of their outer surfaces also applies to securing portion 15.

If the fancy artefact according to the invention is not a watch wristlet and is required to be secured to another object, it may comprise a securing portion similar to portion 15 described above. The shape of such a securing portion and the way in which it is connected to the object may vary widely.

Figure 12:
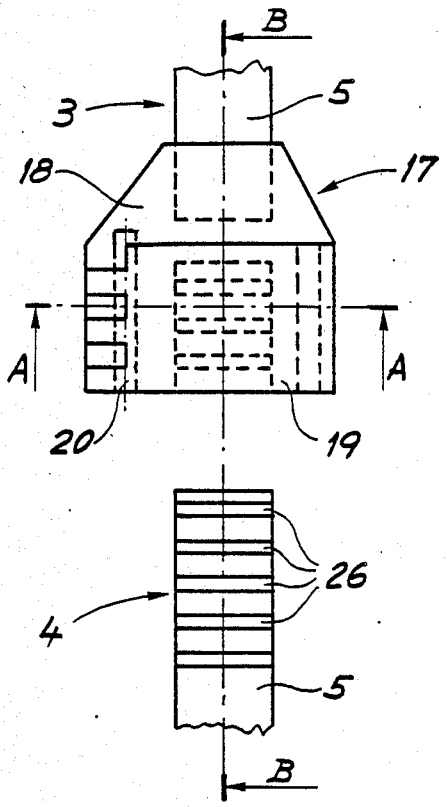
FIG. 12 is a plan view of closure means suitable for use with the wristlet of FIG. 2.
Figure 13:
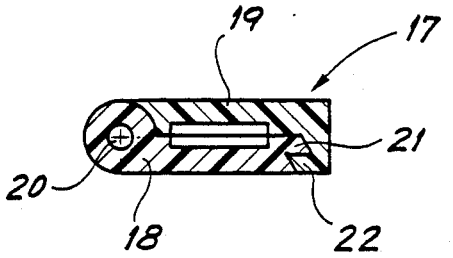
FIGS. 13 and 14 are respectively sections along lines A—A and B—B of the closure means of FIG. 12.
Figure 14:
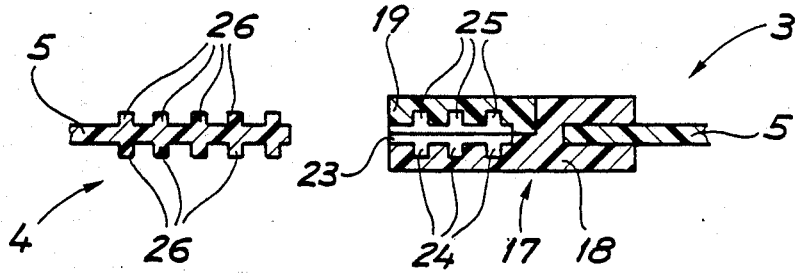

The closure means shown in FIGS. 12 to 14 may be provided on any of the constructional forms of wristlet illustrated in FIGS. 2 to 11. To this end, one of the wristlet bands, e.g. 3, is fitted with a clasp 17 designed to cooperate with the end of the other band, e.g. 4, to close wristlet 1.

The clasp 17 has a base portion 18 and a flat portion 19. Part of base portion 18 closely fits round and is solid with the end of band 3. Clasp portions 18 and 19 are hingedly connected by a pin 20 to form a kind a hinge assembly.

Clasp portions 18 and 19 have disengageable snapping edges 21 and 22 located opposite pin 20. The actual shape of the snapping edges will not be described in detail and may be fairly freely determined. For the snapping action to be possible, and the subsequent disengagement, one or both of the clasp portions should be sufficiently resilient, at least in the region of edges 21 and 22. This resiliency may be achieved by suitably selecting the material used to produce the relevant clasp portion and the shape of the latter in the region of edges 21 and 22.

When clasp 17 is closed, it defines in its central part a cavity 23 which is open at the end of clasp 17 remote from band 3.

The walls of clasp portions 18 and 19 that define cavity 23 are formed with recesses 24 and 25, respectively, in facing relationship, which in the present instance consist of parallel grooves.

The end of band 4 is formed with protuberances 26 shaped to fit recesses 24 and 25, i.e. parallel ribs in the present case, and designed to cooperate with recesses 24 and 25 to retain the end of band 4 in clasp 17 when the latter is closed.

The simple way in which clasp 17 works will be readily apparent from the drawings and the above description without it being necessary to say any more about it.

In this arrangement the part of core portion 5 that is engaged by flap portion 18 may comprise one or more protuberances similar to protuberances 5a in FIGS. 3 and 4, or one or more recesses similar to recesses 5b in FIG. 6.

In such cases flap portion 18 is formed with the corresponding recess(es) or protuberance(s).

These protuberances and recesses serve to reinforce the bonding action between clasp 17 and core portion 5 of band 3.

Clasp portions 18 and 19 may be produced at the same time as decorative portions 6, using the same material. It suffices to give the moulds being used the required shape.

What has been said about the shape of decorative portions 6 and the state of their outer surfaces also applies to the outer surfaces of clasp 17.

Pin 20 connecting clasp portions 18 and 19 and the parts of the latter with which pin 20 cooperates may be replaced by a thin blade of the same plastic material as clasp portions 18 and 19. This thin blade is made at the same time as portions 18 and 19 and is integral therewith. The thickness of this blade should be sufficiently thin to be flexible and enable relative motion between portions 18 and 19.

The various modifications discussed above for clasp 17 have not been illustrated.

Depending on the nature of the fancy artefact, the latter may comprise only one band instead of two as in the wristlet of FIG. 1 and its various constructional forms described and illustrated.

One such fancy artefact may be a belt. Clasp 17 may then be secured to one end of the belt with the other end thereof being formed with protuberances similar to protuberances 26 in FIGS. 12 and 14.

Another fancy artefact involving only one band may be a sling for carrying an object such as a handbag. In such a case, one end of the single band may be secured to the object in any desired manner, e.g. by means of a securing portion similar to securing portion 15 in FIG. 11. Clasp 17 may then be secured either to the object per se, in which case it is the opposite end of the single band that is provided with protuberances similar to protuberances 26 in FIGS. 12 and 14, or to the opposite end of the single band, in which case the object may be provided with a tab formed with such protuberances and designed to cooperate with clasp 17.

Various other modifications may be made to the fancy artefact according to the invention as described and illustrated.

For instance, the core portion of the band or bands may have a cross-section other than strap-like. The aspect of the artefact may readily be modified by resorting to other suitable thermoplastic plastic materials, or by simply changing the colour of one or both of the materials being used.

The aspect may also be modified by changing the shape of the moulds into which the plastic materials are injected.

Further, the fancy article according to the invention is well suited to mass production so that its cost price may be kept quite low.

We claim:

1. A band of generally elongated shape such as a wristlet for an ornamental artefact, said band comprising an elongated core portion made of a first thermoplastic plastic material having a first melting temperature, and an annular decorative portion surrounding said elongated core portion over only part of the length thereof such that a substantial part of said elongated core portion is visible, said annular decorative portion being made of a second thermoplastic plastic material having a second melting temperature equal to or greater than said first melting temperature, being molded around said elongated core portion, and being immovably bonded to said elongated core portion by a layer comprising a fused fixture of said first and second thermoplastic plastic materials.

2. An artefact band as in claim 1, wherein said decorative portion is formed with a recess and said core portion has, on the part thereof surrounded by said decorative portion, a protuberance engaged in said recess.

3. An artefact band as in claim 1, wherein said core portion is formed with a recess and said decorative portion has a protuberance engaged in said recess.

4. An artefact band as in claim 1, wherein said core portion has a pair of protuberances disposed on opposite sides of said decorative portion.

5. An artefact band as in claim 1, wherein said band further comprises a securing portion made of said second thermoplastic plastic material and having at least a part thereof surrounding and immovably bonded to one end of said elongated core portion.

6. An artefact band as in claim 5, wherein said securing portion is formed with a recess and said core portion is formed with a protuberance on said end engaged in said recess.

7. An artefact band as in claim 5, wherein said end is formed with a recess and said securing portion is formed with a protuberance engaged in said recess.

8. An artefact band as in claim 1, wherein said band further comprises a clasp made of said second thermoplastic plastic material and having at least a part thereof surrounding and immovably bonded to one end of said elongated core portion, said clasp having means for fastening it to the other end of said elongated core portion or to one end of another compatible band.

9. An artefact band as in claim 8, wherein said clasp is formed with a recess and said core portion is formed with a protuberance on said one end, engaged in said recess.

10. An artefact band as in claim 8, wherein said one end is formed with a recess and said clasp is formed with a protuberance engaged in said recess.

11. An artefact band as in claim 1, wherein said second plastic material has a melting temperature greater than the melting temperature of said first plastic material.

12. An artefact band as in claim 1, wherein said band further comprises a plurality of said annular decorative portions spaced from each other by an intermediate gap through which said elongated core portion is visible.

* * * * *